US006913415B1

(12) United States Patent
Tagg

(10) Patent No.: US 6,913,415 B1
(45) Date of Patent: Jul. 5, 2005

(54) MODULAR BARRIER

(76) Inventor: Richard Leach Tagg, Ringshall House, Sandhutton, York YO4 1JZ (GB)

( * ) Notice: Subject to any disclaimer, the term of this patent is extended or adjusted under 35 U.S.C. 154(b) by 0 days.

(21) Appl. No.: 09/724,284

(22) Filed: Nov. 28, 2000

(30) Foreign Application Priority Data

Dec. 1, 1999 (GB) ..... 9928282

(51) Int. Cl.[7] ..... E01F 15/00
(52) U.S. Cl. ..... 404/6
(58) Field of Search ..... 404/6; 256/13.1; 49/49

(56) References Cited

U.S. PATENT DOCUMENTS

| | | | | | |
|---|---|---|---|---|---|
| 540,085 | A | * | 5/1895 | Bauer | 256/13.1 |
| 4,111,401 | A | * | 9/1978 | Pickett | 256/13.1 |
| 4,240,766 | A | * | 12/1980 | Smith et al. | 404/10 |
| 4,498,660 | A | * | 2/1985 | Brema et al. | 256/19 |
| 4,681,302 | A | * | 7/1987 | Thompson | 256/13.1 |
| 5,104,255 | A | * | 4/1992 | Bodensohn | 404/7 |
| 5,676,350 | A | * | 10/1997 | Galli et al. | 256/13.1 |
| 5,836,714 | A | | 11/1998 | Christensen | |
| 5,882,140 | A | * | 3/1999 | Yodock et al. | 404/6 |
| 5,988,934 | A | * | 11/1999 | Wasserstrom | 404/6 |
| 6,059,491 | A | * | 5/2000 | Striefel et al. | 405/111 |
| 6,164,865 | A | * | 12/2000 | McCallum | 404/6 |
| 6,203,424 | B1 | * | 3/2001 | Gallant | 404/6 |
| D439,935 | S | * | 4/2001 | Tagg | D21/483 |
| 6,439,801 | B1 | * | 8/2002 | Galiana et al. | 404/6 |

FOREIGN PATENT DOCUMENTS

| | | | | |
|---|---|---|---|---|
| DE | G 92 12 640.5 U1 | | 1/1993 | |
| EP | 0618332 A1 | | 10/1994 | |
| EP | 0957206 A1 | | 11/1999 | |
| FR | 2691728 A1 | | 12/1993 | |
| FR | 2719063 A1 | | 10/1995 | |
| FR | 2757888 A1 | | 7/1998 | |
| GB | 2292404 A | | 2/1996 | |
| WO | WO 97/09485 | * | 9/1996 | E01F 15/08 |
| WO | WO 97/09485 | * | 3/1997 | E01F 15/05 |
| WO | WO 97/09485 | * | 3/1997 | E01F 15/08 |
| WO | WO 97/09485 A1 | | 3/1997 | |
| WO | WO 99/53145 A1 | | 10/1999 | |

* cited by examiner

*Primary Examiner*—Robert E. Pezzuto
*Assistant Examiner*—Raymond W Addie
(74) *Attorney, Agent, or Firm*—Edwin D. Schindler

(57) ABSTRACT

A modular barrier includes a plurality of identical barrier sections. Each section 10 includes a base portion 12 surmounted by an upright portion 14. The upright portion has projections 16, 18 with substantially semicylindrical outer surfaces at its ends. Correspondingly shaped recesses 20, 22 are also provided. At a female end, the base portion 12 includes a nose 28. The surface of the nose is a surface of rotation of the profile of the base portion 12. At the male end, the base portion 12 includes a correspondingly shaped cavity 30. The first and second projections 16, 18 and nose 28 are provided with bores 32, 34, 36. When the female end of the barrier section 10 is brought up to a male end of a similar section, the projections mate with one another and the nose 28 is received in the cavity 30 of the similar section. A hinge pin (not shown) may then be passed through the bores 32, 34, and 36. By means of this device, one barrier section can be articulated to the next and the joint between the two base portions of adjacent barrier sections presents an essentially smooth profile irrespective of the angle between the two.

24 Claims, 12 Drawing Sheets

72

BARRIER PROTECTOR STRIP

TYPICAL END SECTION.

MODULAR BARRIER

BACKGROUND TO THE INVENTION

This invention relates to modular barriers of the type used in crowd and traffic control.

Conventional modular traffic control barriers consist of a number of barrier sections made from cast concrete. Each barrier section has a comparatively narrow upright portion surmounted by a comparatively wide base portion. Metallic ties are cast into the concrete and project from both ends of the upright portion of the barrier section. When two barrier sections are placed side-by-side, the metallic ties line up and can be bolted through, thus attaching the barrier sections to one another and at the same time forming a makeshift hinge. By means of the hinge, the two barrier sections can be articulated relative to one another, allowing the completed barrier to follow a serpentine path if desired.

Because the base portions of the barrier sections are comparatively wide as compared with the upright portions, the hinge-point at which the metallic ties are bolted to one another is spaced some distance away from the ends of the barrier sections. This is to allow a reasonable degree of angular movement between adjacent barrier sections, but means that the ends of the barrier sections cannot lie flush. It also means that as the adjacent barrier sections deviate more from being directly in line, a gap opens up between the edges of the base portions that lie towards the outside of the bend that the barrier is following. This opening can act as a wheel trap for unwary motorists. The same problem exists with barriers used for crowd control, except the gap is a tripping hazard.

A crowd control barrier of the type that suffers from this problem is described in U.S. Pat. No. 5,836,714. The barrier in question is particularly well illustrated in FIG. 9 of that document. The barrier is modular, being constructed of a series of substantially identical barrier sections. Each section is articulated to an adjacent section or two adjacent sections by means of a pin that passes through shaped projections in the sections. Upper and lower shaped projections are formed at one end of each section and a median shaped projection is formed at the other end. In this way, the pin passes through an upper projection of one section, a median projection of an adjacent % ection and then the lower projection of the first section. Each section is ramp-shaped and lies almost entirely to one side of the line drawn between the two articulating pins of the section in question. This arrangement allows the barrier to bend in one direction, opening up a gap between the adjacent ramp-shaped sections, but does not permit it to bend in the other direction.

A modular traffic control barrier in which adjacent sections are connected to one another by a pin is described in U.S. Pat. No. 4,681,302. However, this barrier is one in which no articulation of the sections relative to one another is possible. Instead, if a bend is required in the harrier, shaped inserts and additional connecting pins have to be introduced between sections. FIGS. 5–8 of the document illustrate a number of configurations that can be achieved with such inserts.

A more flexible modular traffic control barrier is described in international patent application no. WO99/53145. Here the barrier sections, viewed in plan, have a semicircular nose at one end and a corresponding semicircular recess at the other. However, because of its shape, the barrier is of uniform width rather than possessing a wide base and a narrow upright portion, which means that either it is very wide or it is likely to fall over. The noses and recesses mean that adjacent barrier sections may be placed at an angle to each other. UK patent application no. GB 2,292,404 A describes something similar.

SUMMARY OF THE INVENTION

The present invention is designed to address the problem with conventional articulated modular barriers as discussed above. In common with such conventional modular barriers, the modular barrier of the present invention is formed from barrier sections. A barrier section comprises a comparatively narrow upright portion having one or more projections at each end and a comparatively wide base portion including, at a female end of the barrier section, a nose having a surface that is a surface of rotation of the profile of the base portion and, at a male end, a correspondingly shaped cavity, in which, when the female end of the section is brought up to a male end of another such section, the projections mate with one another, allowing a hinge pin to be passed through them to articulate the sections together and the nose is accommodated in the cavity to prevent any gaps from opening up between the base portions of the two barrier sections as they are so articulated.

Because the nose is a surface of rotation and the cavity is correspondingly shaped, the joint between the two base portions of adjacent barrier sections presents an essentially smooth profile irrespective of the angle between the two, which in preferred embodiments of the invention can vary between ±45 degrees. No gaps are opened up as the nose rotates within the cavity. Eventually, the base portion of the barrier section with a female end will impinge on the edge of the cavity in the base portion of the barrier section with a male end, thus preventing further movement, but on the other side, the exposed section of the nose presents an essentially smooth transition from the base portion of one barrier section to the base portion of the other. As a result, no openings are formed and the wheel trap or tripping hazard of conventional barriers is avoided.

Returning to the case of traffic control, as described above, the need to hinge the barrier sections of the conventional sort away from the ends of the upright portions causes spaces between adjacent barrier sections. These can be a problem when the barriers are used for contra-flow systems at night: oncoming vehicles' lights can dazzle if they shine through these gaps. For this reason, it is preferred in the barrier section of the present invention that, for each projection, a corresponding recess is provided on the other end of the barrier section. As the projections of one barrier section will fit within the recesses in another, the gap between the two can be substantially closed. Taking this idea further, each projection may be given a surface that is a surface of rotation, for example substantially part-cylindrical. The respective corresponding recesses may then be correspondingly shaped. This arrangement ensures that no gaps open up between the upright portions as the barrier sections articulate relative to one another, just as the nose and cavity do for the base. The net result is of a tight-fitting hinge.

As with most hinges, each projection on a barrier section may be provided with a bore so that, when the female end of the section is brought up to a male end of another section so that the nose is accommodated in the cavity, the bores in the projections line up allowing a hinge pin to be passed through them to articulate the sections together. Further rigidity can be imparted to the hinge if the nose also includes a bore, allowing the hinge pin to pass through it.

When a plurality of barrier sections according to the invention aid hinge pins are assembled into a modular barrier, the projections on a female end of a first barrier section mate with the projections on a male end of another barrier section and a hinge pin passes through them and through the nose of the first barrier section, to articulate the sections together.

To secure the hinge pin in place, it may have a male thread that engages with a female thread in a dome-shaped cap, the nose of the first barrier section having a dome-shaped recess to accommodate the cap. The dome-shaped cap can be bolted down to the ground before the barrier is erected. The cap and the recess are dome-shaped so that, although the spacing between adjacent caps is critical, their relative orientation is not, making their installation a much simpler proposition.

Further strength can be imparted to the assembled barrier if the barrier sections are also held together by tension straps that encircle adjacent barrier sections, crossing from one side of the barrier to the other between the barrier sections. These can spread impact forces across a number of adjacent barriers. For ease of installation of the straps, the upright portion of each barrier section may be provided with grooves to accommodate them.

Male and female end pieces can be used to complete the barrier. One or more openings in the side of the upright portions may be used to accommodate indicia such as reflective arrows or speed limit signs etc.

In another embodiment of the present invention, a modular barrier is assembled front barrier sections that are not substantially identical. In that case, the modular barrier includes a plurality of barrier sections, each comprising a comparatively narrow upright portion having one or more projections at each end, and a comparatively wide base portion including, at a female end of the barrier section, a nose having a surface that is a surface of rotation and, at a male end, a cavity having a surface that is a surface of rotation, in which for each such section there exists another section such that when the female end of the section is brought up to the male end of that other section, the projections mate with one another, allowing a hinge pin to be passed through them to articulate the sections together and the nose is accommodated in the cavity to prevent any gaps from opening up between the base portions of the two barrier sections as they are articulated relative to one another about the hinge pin. Of course, the barrier sections may be substantially identical.

BRIEF DESCRIPTION OF THE DRAWINGS

The present invention will now be described by way of example with reference to the accompanying drawings in which.

DETAILED DESCRIPTION OF THE INVENTION

Figures 1, 2:
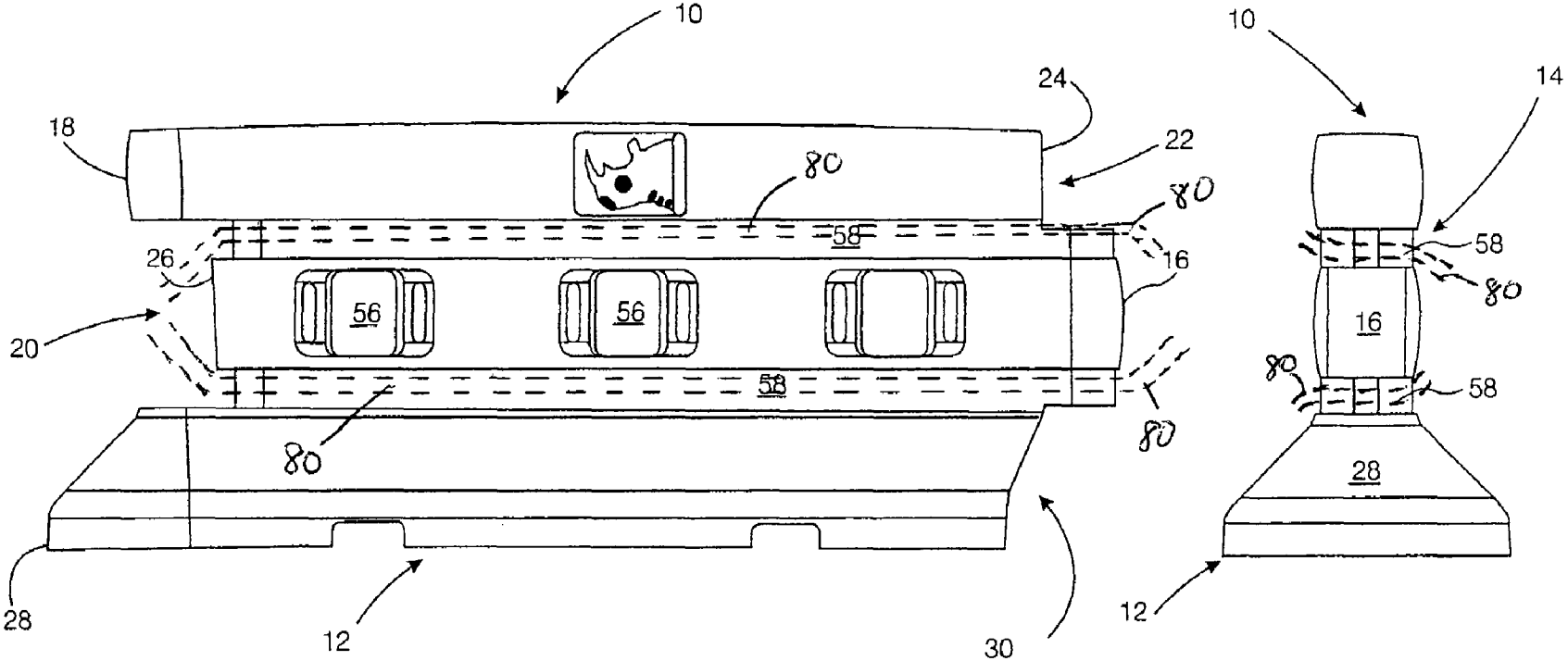
FIG. 1 is a side view of a barrier section, showing the female end on the left and the male end on the right.
FIG. 2 is an end view of the female end.
Figure 3:
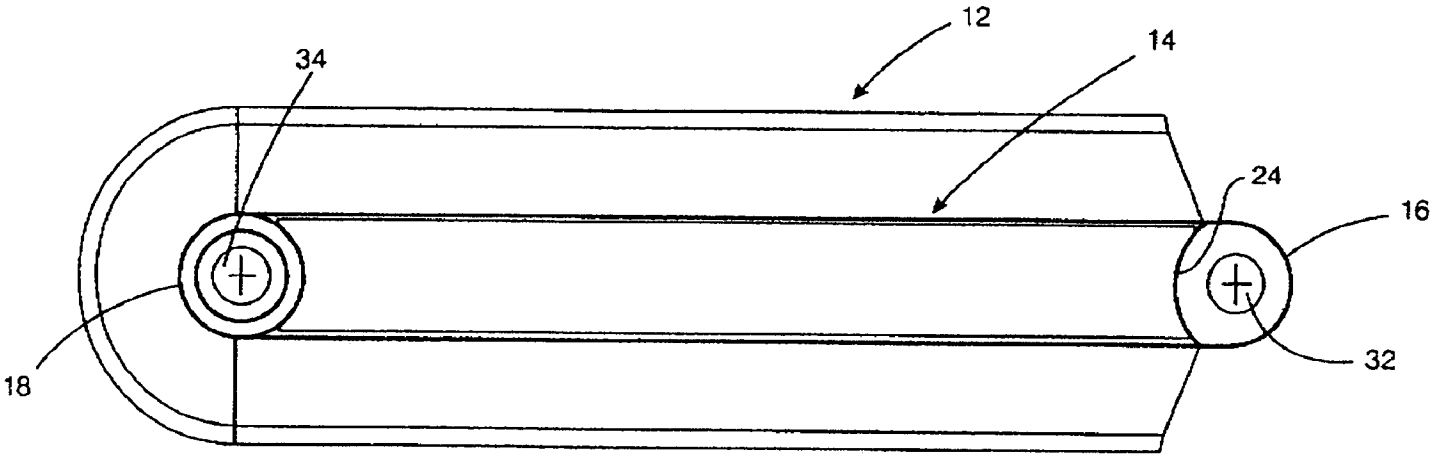
FIG. 3 is a plan view.

FIGS. 1 and 2 show a barrier section 10 that is formed by rotation moulding from high-density polyethylene. Because the barrier section is rotation moulded, it is hollow and can be filled with water when in use for traffic control. To that end it is provided with a filling port and a drain plug (not shown). The barrier section includes a comparatively wide base portion 12 surmounted by a comparatively narrow upright portion 14. The upright portion has a first projection 16 at a male end of the barrier section and a second projection 18 at the female end. As is more clearly shown in FIG. 3, when considered in conjunction with FIGS. 1 and 2, both projections have substantially semicylindrical outer surfaces. The first projection 16 is designed to fit into a correspondingly shaped first recess 20 that lies below the second projection 18 of a similar barrier section. The second projection 18 is designed to fit into a correspondingly shaped second recess 22 that lies above the first projection 16 of the similar barrier section. As cart again be seen from FIG. 3, when considered in conjunction with FIGS. 1 and 2, the second recess 22 includes a part-cylindrical surface 24. The same is true of the first recess 20 and surface 26.

At the female end, the base portion 12 includes a nose 28. The surface of the nose is a surface of rotation of the profile of the base portion 12. At the male end, the base portion 12 includes a correspondingly shaped cavity 30, better illustrated in FIG. 4. The first and second projections 16, 18 are provided with bores 32, 34 and the nose 28 is also provided with a bore 36. The nose also includes an inverted dome-shaped or part spherical recess 38 that will be described later.

When the female end of the barrier section 10 is brought up to a male end of a similar section, the projections mate with one another. The first projection 16 is received in the first recess 20 below the second projection 18 of the similar section. The second projection 18 of the similar section is received in the second recess 22 above the first projection 16. The corresponding substantially part-cylindrical surfaces of the projections 16, 18 and recesses 20, 22 are in close proximity to one another. The nose 28 is received in the cavity 30 of the similar section, again with their surfaces in close proximity. A hinge pin (not shown) may then be passed through the bores 32, 34, 36, in that order, and screwed down or otherwise fixed into a dome-shaped cap (not shown) that sits within the recess 38 in the nose 28. The pin may be made from plastics, e.g. nylon, or a metal such as steel. The pin head may have a socket to receive a warning lantern.

By means of this device, one barrier section 10 can be articulated to the next. As will be appreciated, because the nose 28 is a surface of rotation and the cavity 30 is correspondingly shaped, the joint between the two base portions 12 of adjacent barrier sections 10 presents an essentially smooth profile irrespective of the angle between the two. Movement is eventually restricted by the base portion 12 of one barrier section 10 impinging on the edge of the cavity 30 in the base portion of the other barrier section 10. However, on the other side, the exposed section of the nose 28 forms an essentially smooth arcuate transition from the base portion 12 of one barrier section 10 to the base portion 12 of the other. Similarly, as the projections 16, 18 of one barrier section 10 tit within the recesses 20, 22 in the other and vice versa, the gap between the two is substantially closed. Again, the semicylindrical surfaces of the projections 16, 18 and recesses 20, 22 ensure that no gaps open up between the upright portions 14 as the barrier sections 10 articulate relative to one another, just as the nose 28 and cavity 30 do for the base 12. The net result is of a tight-fitting hinge and this helps to prevent a driver being dazzled by oncoming vehicles' lights, especially where the barrier is used in a contra-flow system at night. It also avoids the wheel trap or tripping hazard of conventional barriers.

Figure 7A:
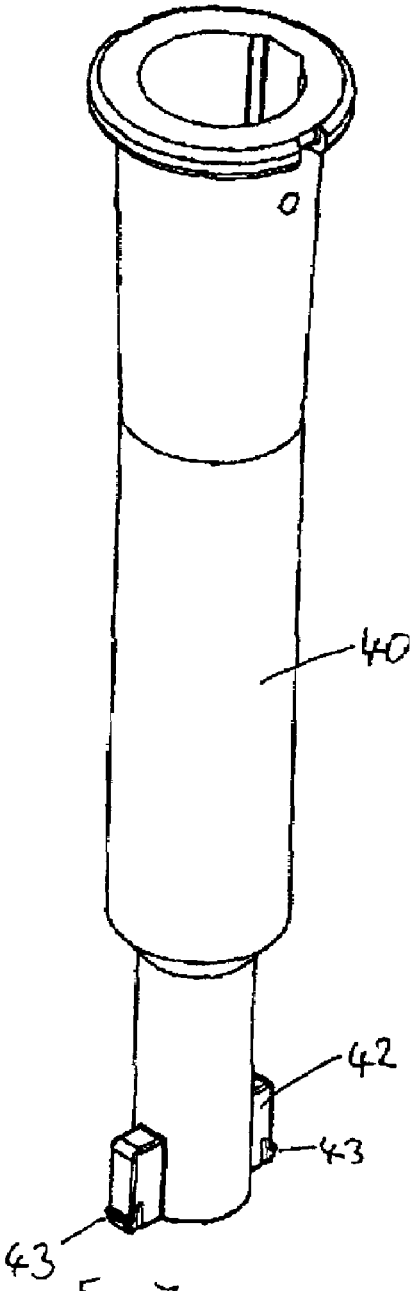
FIGS. 7*a* and 7*b* show an alternative form of hinge pin.
Figure 7B:
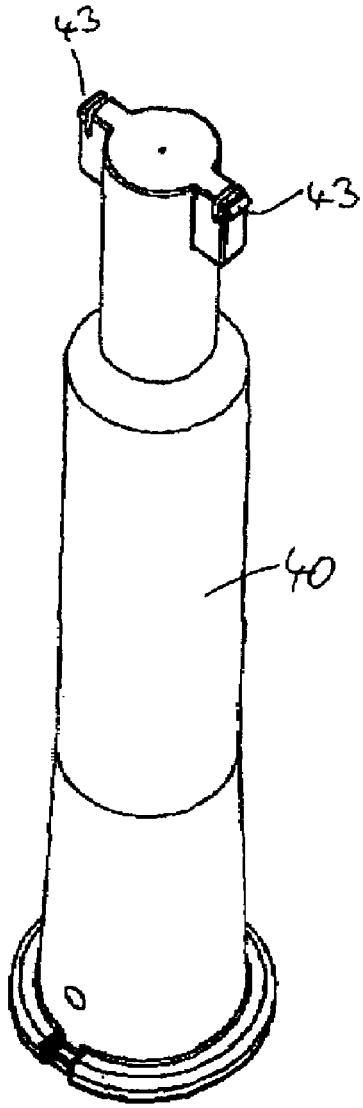
Figure 8A:
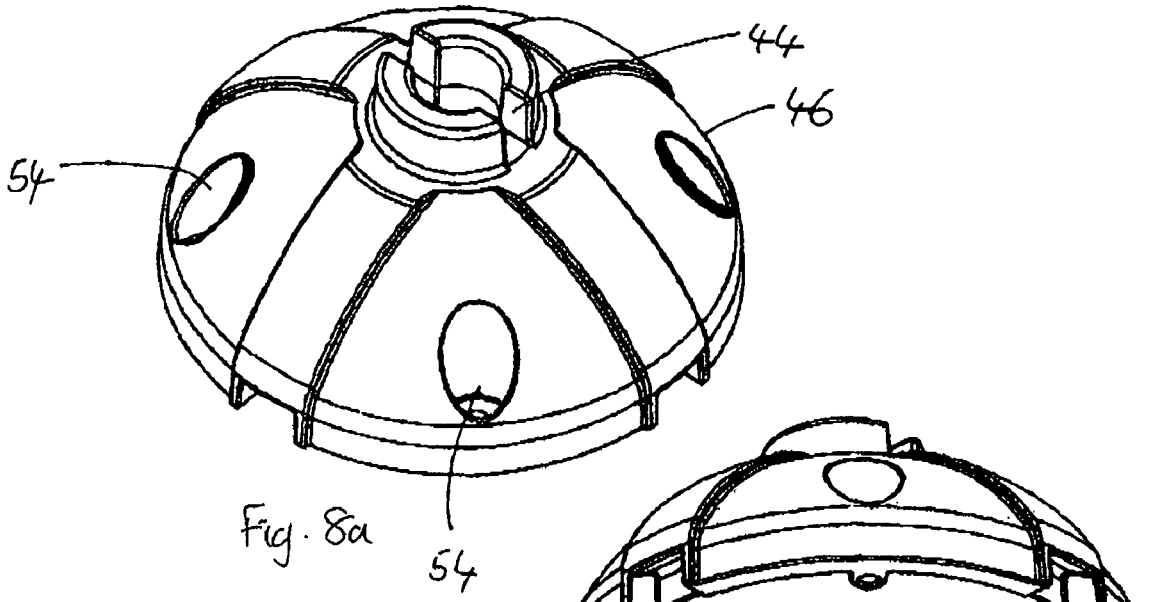
FIGS. 8*a* and 8*b* show a cap for use with the hinge pin of FIGS. 7*a* and 7*b;*
Figure 8B:
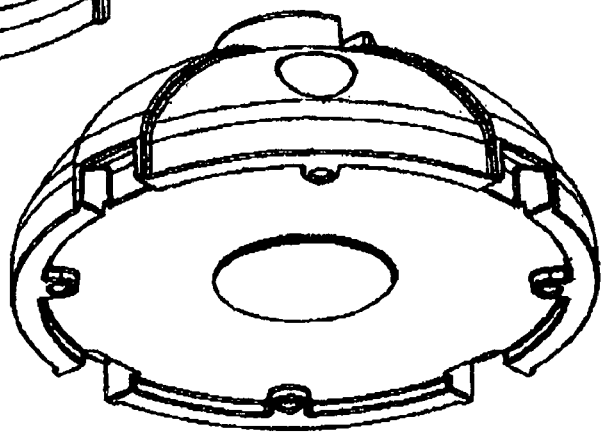
Figure 8B:
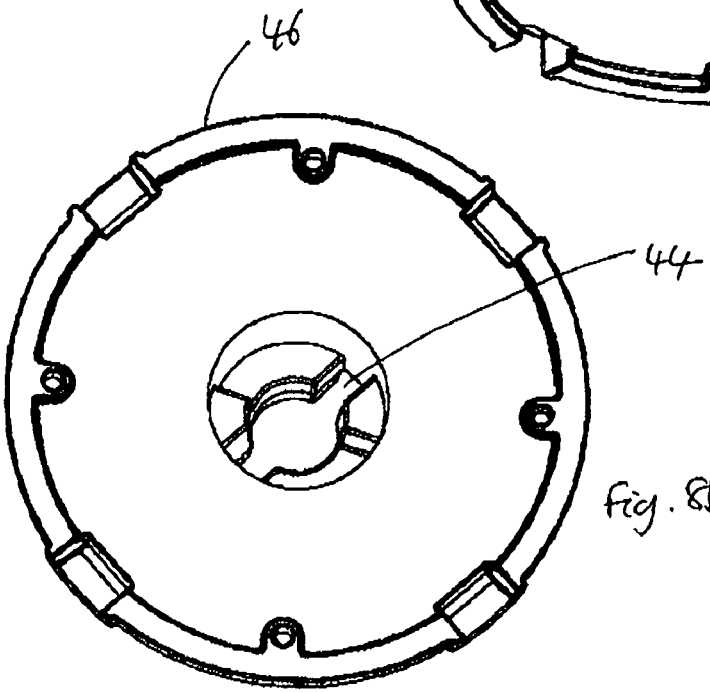
Figure 9:
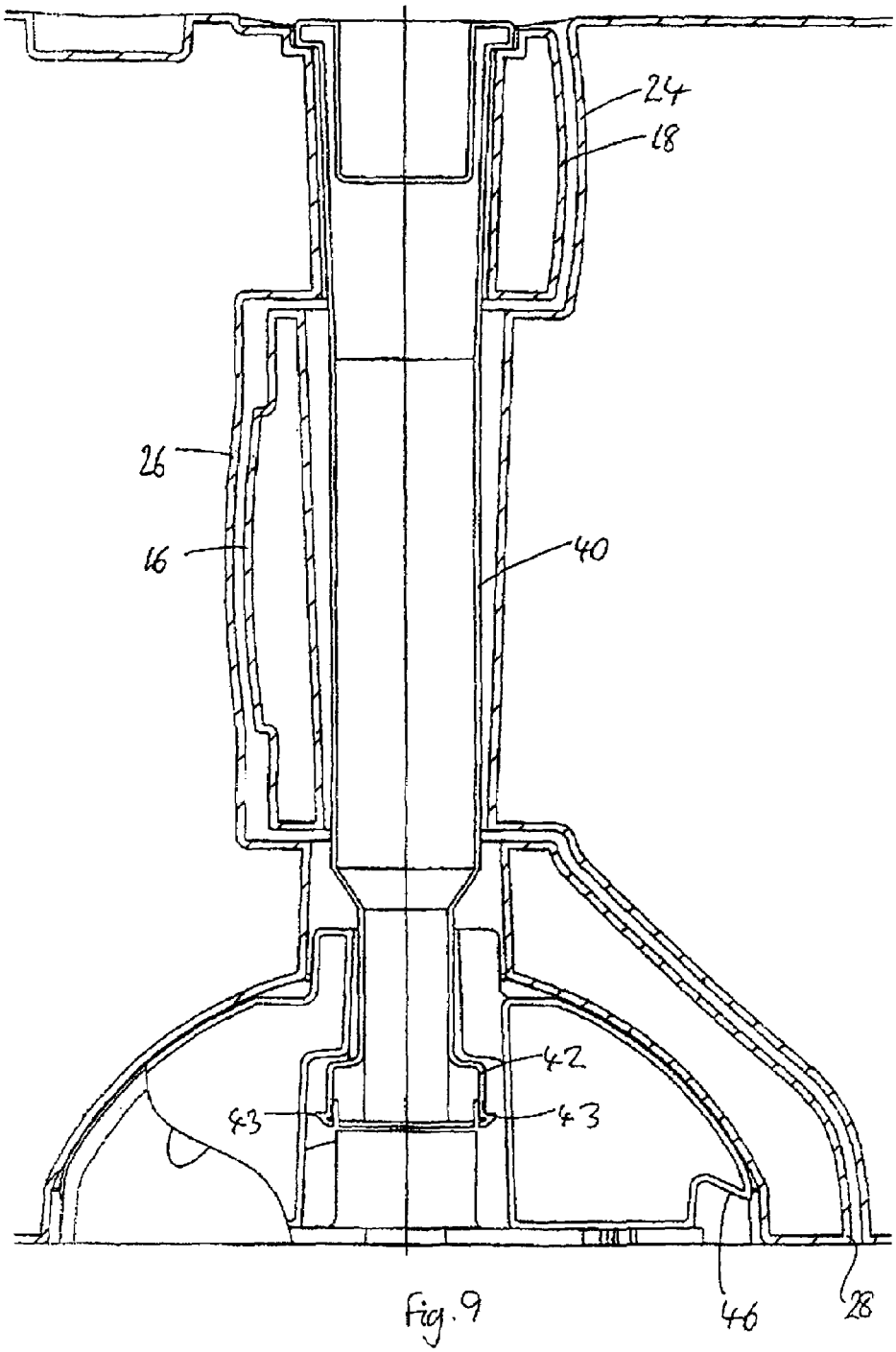
FIG. 9 is a section through a barrier using the hinge pin of FIGS. 7*a* and 7*b* and the cap of FIGS. 8*a* and 8*b;*

As stated above, the hinge pin may have a male thread that engages with a female thread in a dome-shaped cap, the nose of the first barrier section having a dome-shaped recess to accommodate the cap. Alternatively, as shown in FIGS. 7*a*–8*b*, the hinge pin 40 may have a bayonet fitting 42 that slots into appropriate bayonet grooves 44 in the cap 46. As shown in FIGS. 7*a* and 7*b*, the bayonet fitting 42 includes at its extremities a pair of resilient clips 43. The purpose of the clips 43 is to prevent the withdrawal of the hinge pin 40 from the barrier sections without compression of the clips 43. This is a useful safeguard if the bayonet fitting 42 becomes undone. The compression of the clips 43 can be achieved by a suitable tool. The cap 46 may be made of plastics, such as nylon, or metal, such as steel or cast iron. It may be fixed in place by a spike on its lower surface and/or bolted down to the ground with shock bolts through three or four deeply countersunk holes 54 before the barrier is erected. Alternatively, it may be left loose or otherwise secured. An appropriately shaped friction mat could be laid beneath it. The mat may be high-density rubber or polyurethane foam, preferably with a rough-sawn or other high friction surface. Because the caps 46 are dome-shaped, or at least circular when viewed from above, they need only be secured at predetermined centres; their relative orientation is not critical, making their installation a much simpler proposition. FIG. 9 is a section through a barrier using a hinge pin 40 and cap 46 that have the bayonet fittings 42, 44 described above. As can be seen from FIG. 7*a*, a recess 47 is created at the top of the pin 40, which is formed by rotational moulding, to accept a standard highway light.

As can be seen from FIG. 1, each barrier section 10 includes one or more openings 56 in the side that may be used to accommodate indicia such as reflective arrows or speed limit signs, etc. Furthermore, a pair of grooves 58 run along each side and continue around the recesses 20, 22 to join identical grooves on the other side of the barrier section 10. Adjacent barrier sections can be held in place by tension straps 80 (shown in phantom) that encircle them, located within the grooves 58, crossing from one side of the barrier to the other between the barrier sections 10, along the side of barrier section 10 in FIG. 1 and along an end of another, adjacent, barrier section 10, as shown in FIG. 2, somewhat in the form of a figure-of-eight, or a number of superposed figures-of-eight. A suitable material would be 75 mm by 6 mm polypropylene straps. The tension straps may be installed relatively loose and, once in place, tightened by a ratchet mechanism. The tension straps spread impact forces across a number of adjacent barrier sections 10, better dissipating the impact.

Figure 13A:
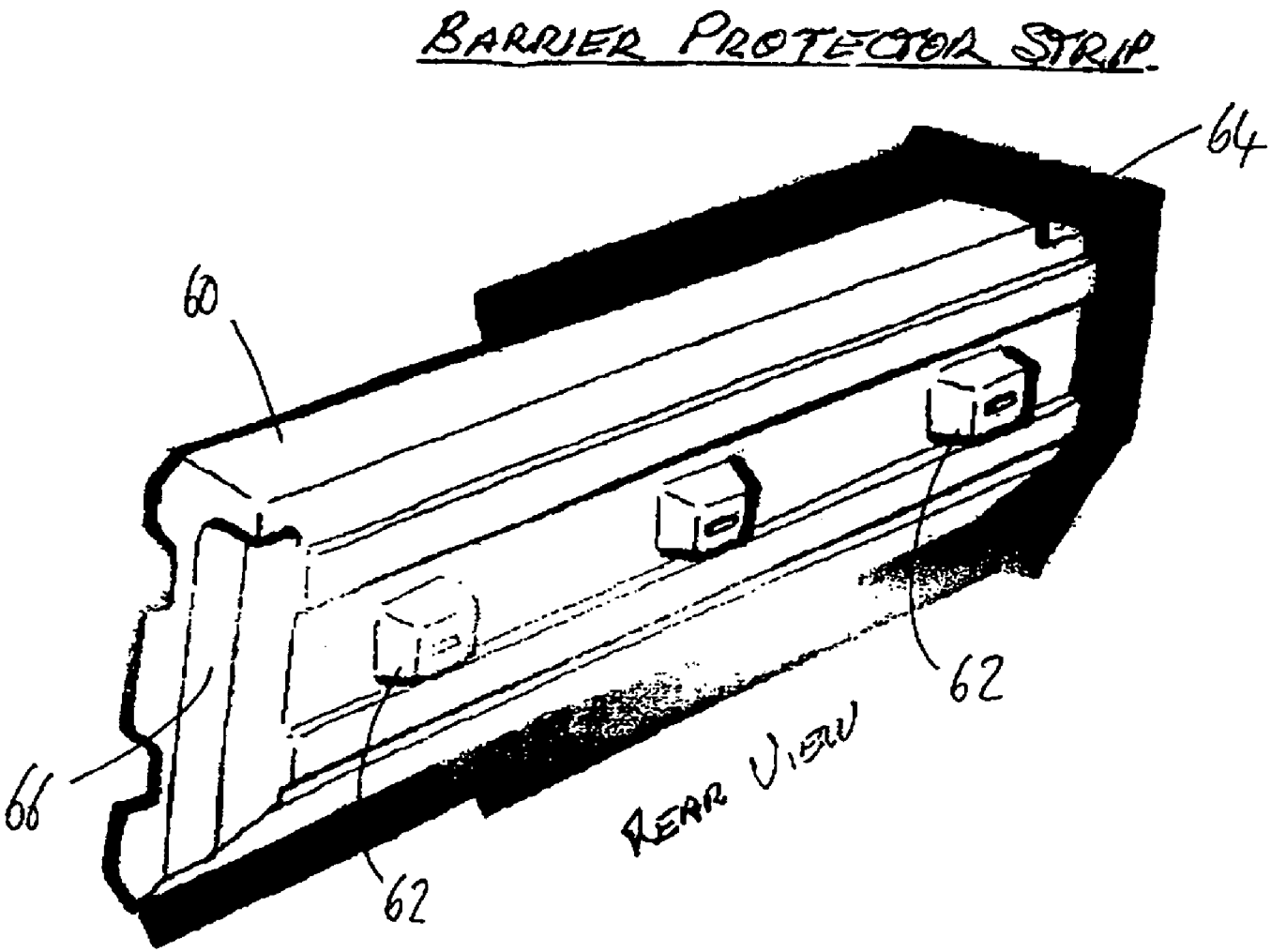
FIGS. 13*a* and 13*b* show an additional protection strip for heavy-duty applications.
Figure 13B:
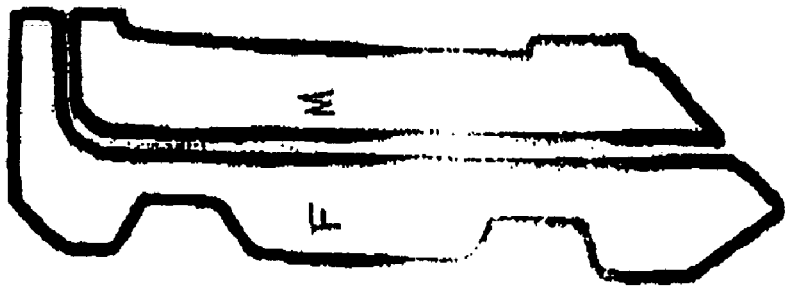
Figure 13B:
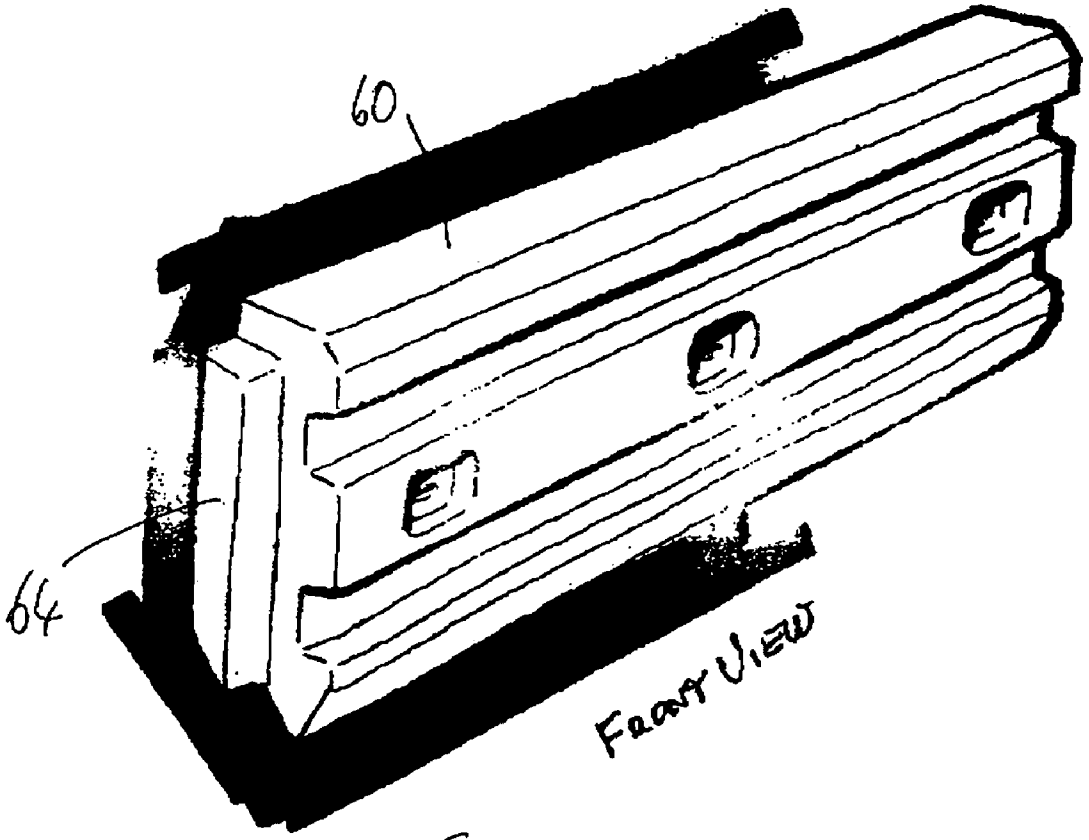
Figure 14:
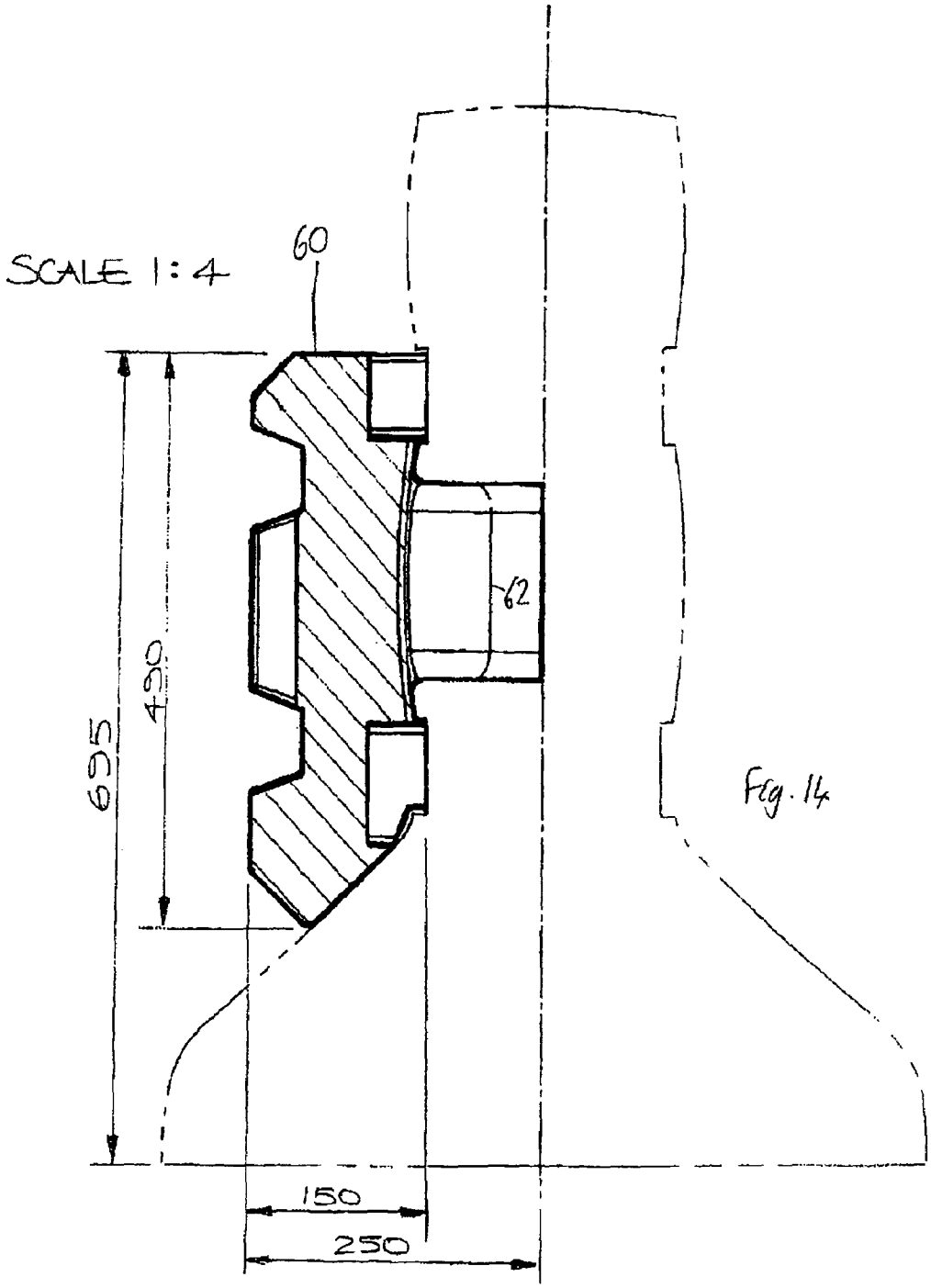
FIG. 14 is a section through a barrier section and protection strip.

FIG. 13 shows an additional protection strip 60 for heavy-duty applications. The strip has a polyethylene skin filled with expanded polyurethane foam and is sacrificial in the sense that, if it is impacted by a moving vehicle, its polyethylene skin is designed to burst, assisting the polyurethane foam filling in absorbing the impact energy. This helps to protect and maintain the integrity of, the barrier sections. As shown in FIG. 14, each strip 60 is profiled to fit a barrier section. It includes bosses 62 that are designed to pass through the openings 56 of a barrier section and abut the bosses 62 of a corresponding strip 60 on the other side. The strips 60 are bolted to one another via the openings 56. As can be seen from FIGS. 13 and 14, the strips 60 are designed to interlock with strips 60 on an adjacent barrier section, but in such a way as to continue to permit the articulation of the sections relative to one another. This is achieved with a boss 64 at one end of a strip 60 engaging a notch 66 in the other end of an adjacent strip. Preferably, the strips 60 are manufactured by rotation moulding to form the skin and foam injection to form the filling.

A further impact absorbing addition (not shown) could be an inverted U-shaped moulding, filled with cushioning plastics material, foam for example, that is slotted over the tops of the barrier sections. It may be designed to be sacrificial, bursting or tearing on impact for example.

Figure 4:
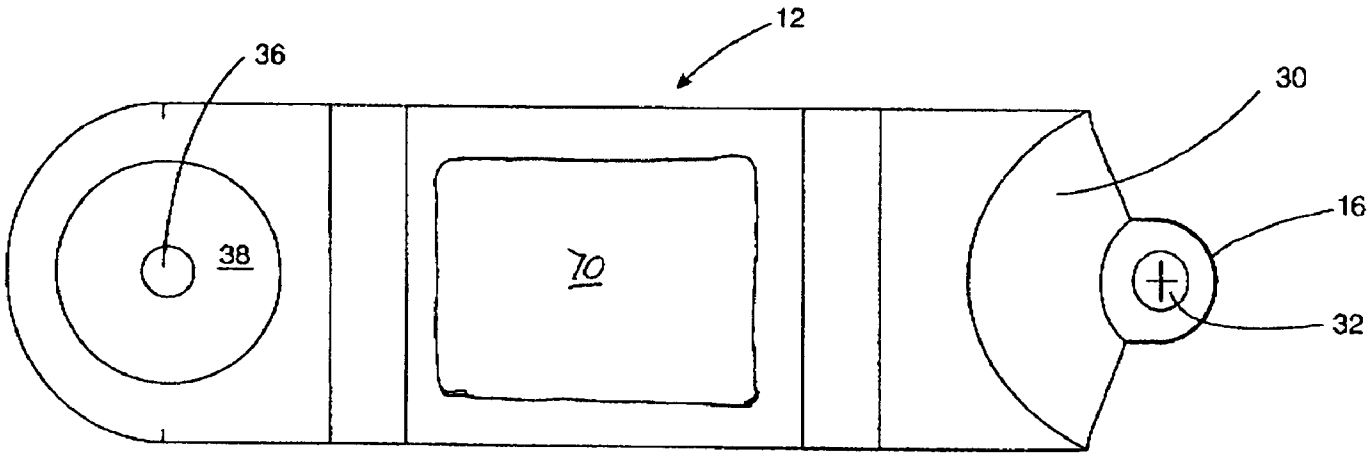
FIG. 4 is an underneath view.
Figure 12:
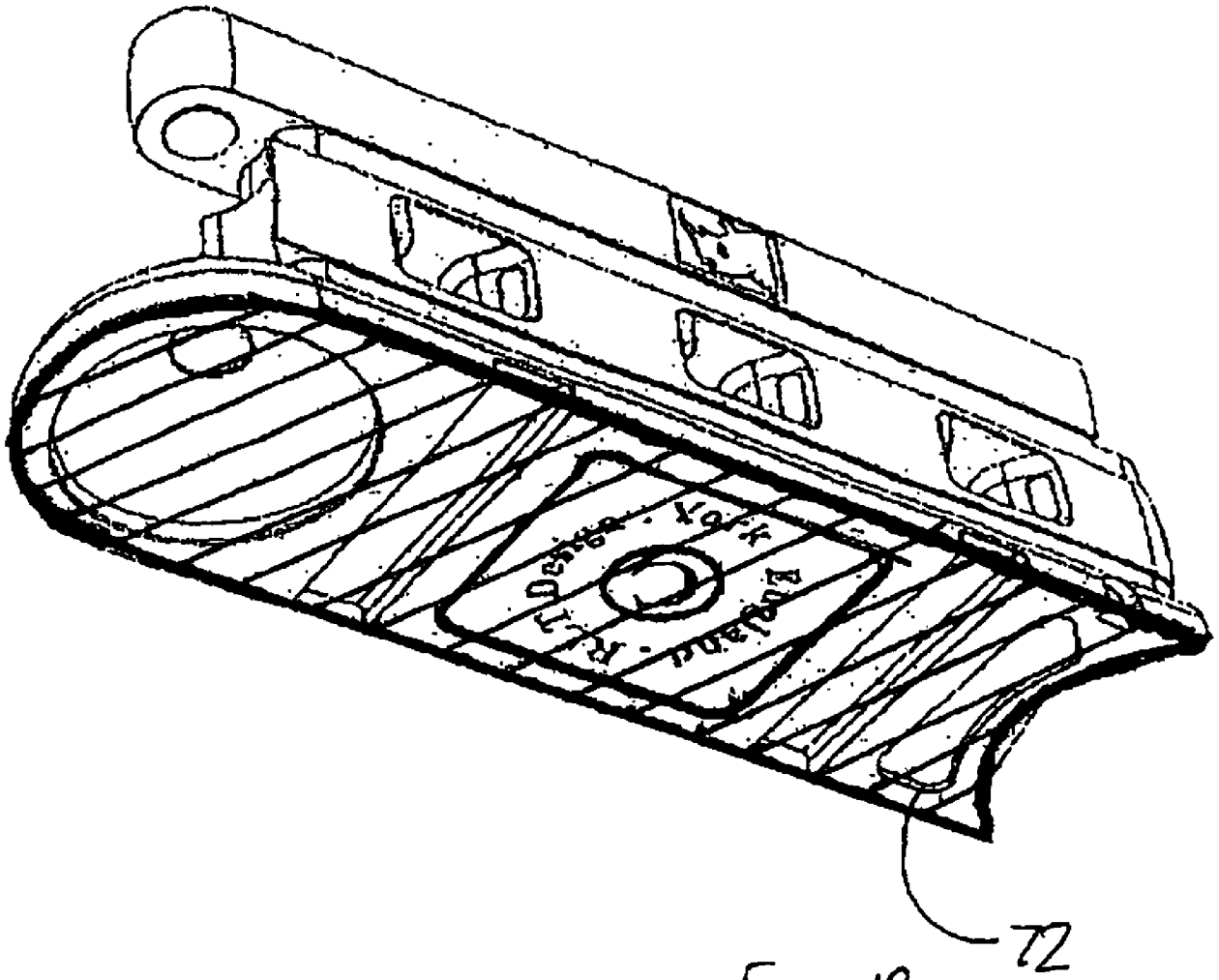
FIG. 12 shows a barrier section with a friction mat.

FIG. 12 shows a barrier section with a friction mat 72. The mat may be fitted into a recess 70 designed for that purpose in the base of the section, as shown in FIG. 4 or may extend across the whole of the base as shown in FIG. 12. Where the recess 70 shown in FIG. 4 is present, and the mat 72 extends across the whole base, it will be thicker in the region of the recess 70, e.g. double thickness, creating an upstand that helps to locate the mat 72 in position. The mat may be high-density rubber or polyurethane foam, preferably with a rough-sawn or other high friction surface.

Figure 6:
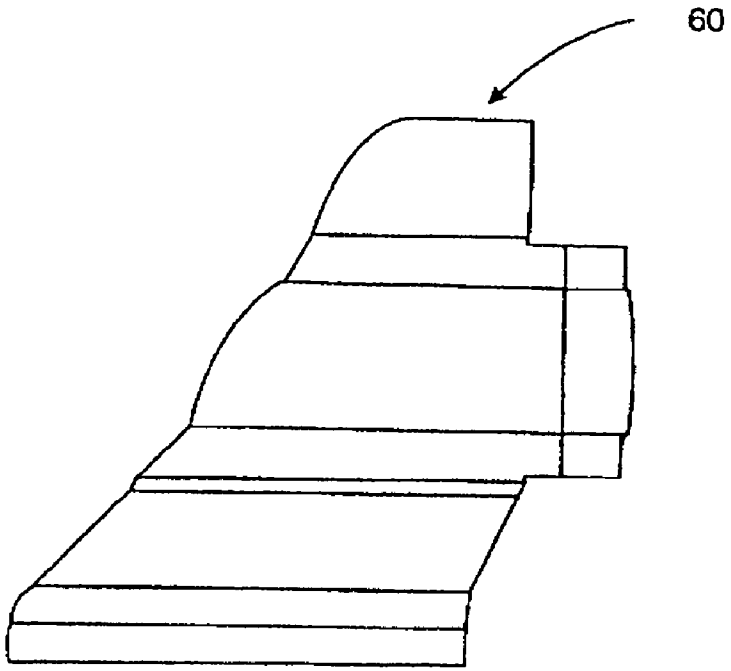
FIG. 6 shows a male end piece.
Figure 5:
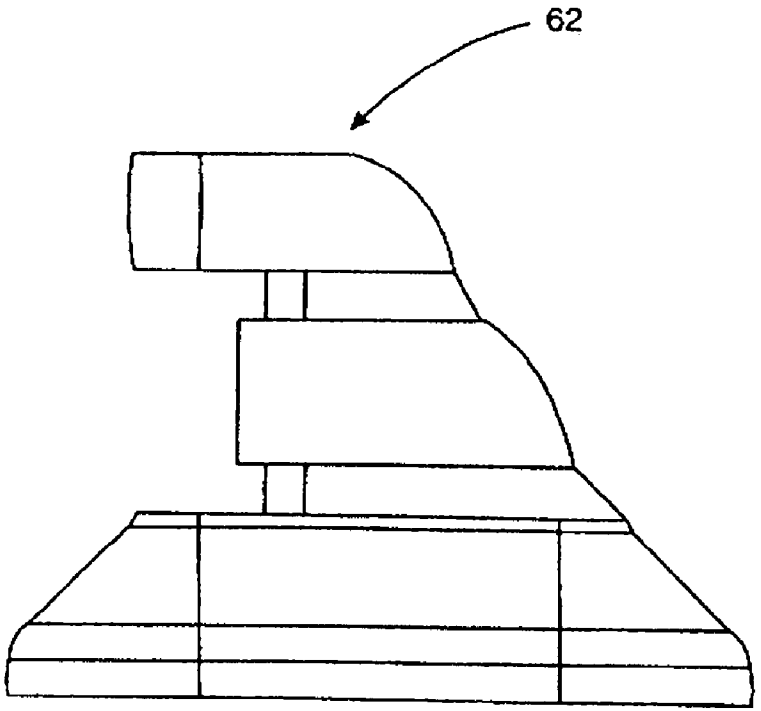
FIG. 5 shows a female end piece.
Figure 10:
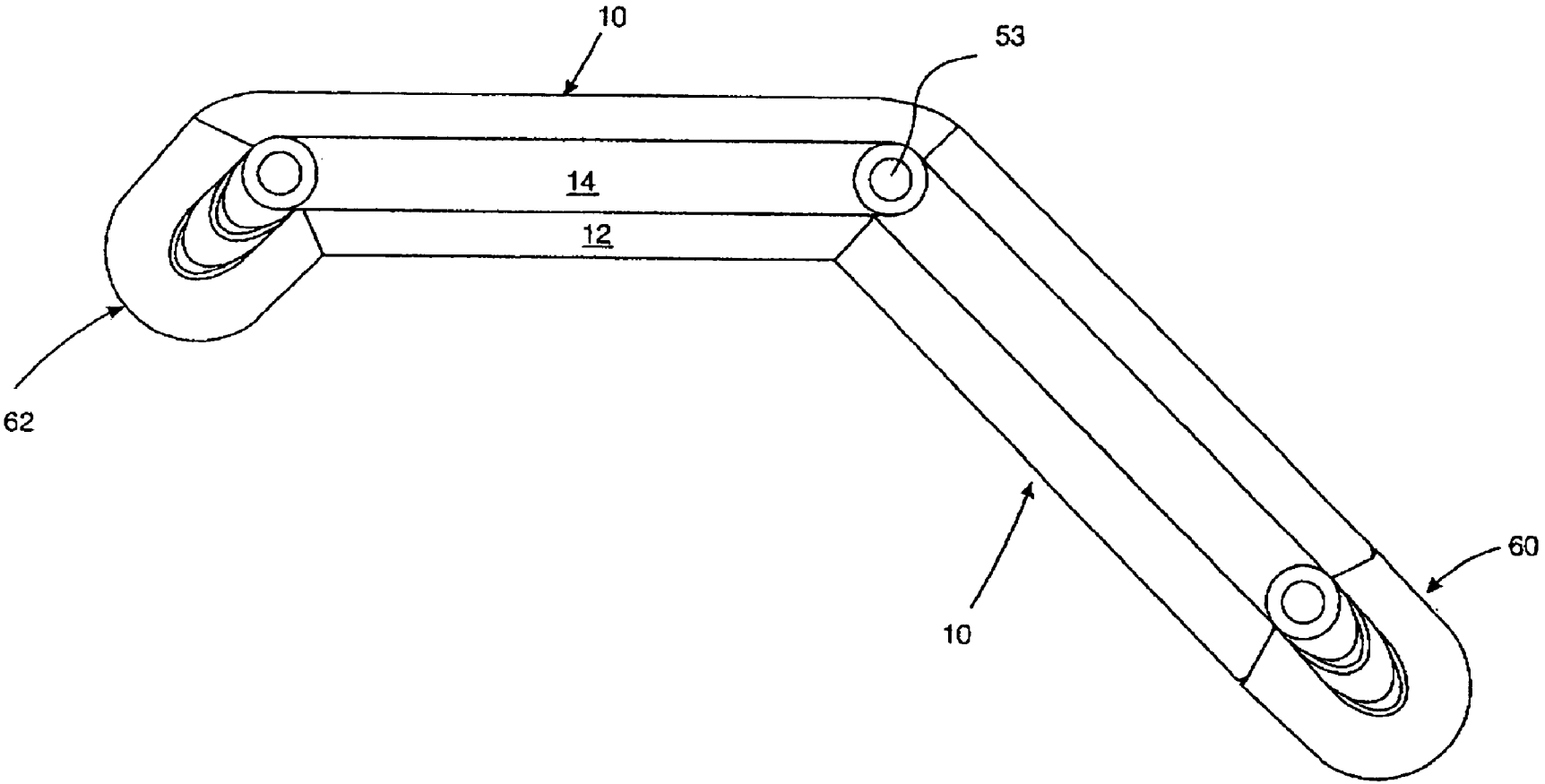
FIGS. 10 and 11 show an assembled barrier.
Figure 11:
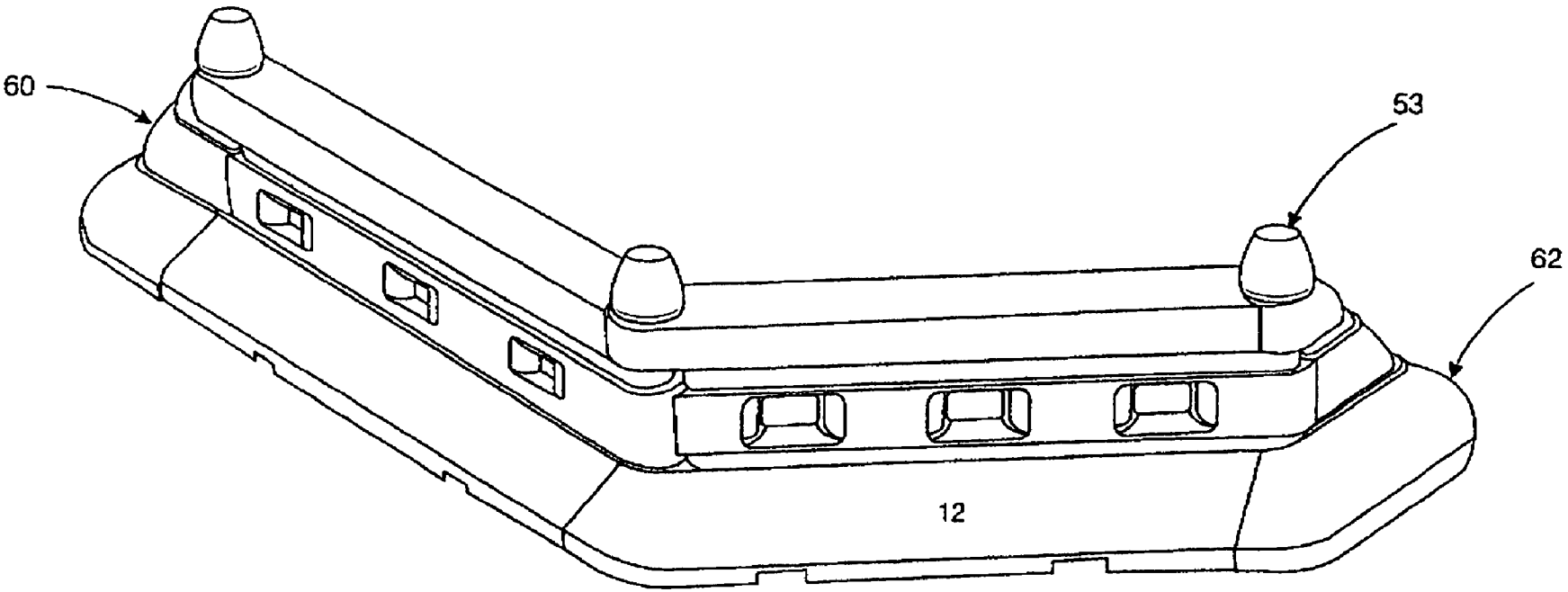

Male and female end pieces 60, 62 are shown in FIGS. 5 and 6. As can be appreciated, these are fixed to the free ends of the terminal barrier sections 10 once the barrier has been erected, to complete the barrier. They are attached to respective barrier sections in exactly the same way as the barrier sections are attached to one another. The fully assembled barrier is shown in FIGS. 10 and 11. A warning light is shown at 53. As FIG. 11 clearly demonstrates, the gaps from which conventional barriers suffer are absent from the present invention, which present an essentially smooth continuous base. This minimises impact damage to driver, vehicle and barrier. In addition, the nose pieces can be positioned at an angle to help guide vehicles into the correct lane, acting somewhat like a funnel.

Whilst the present invention has been described in connection with a unitary barrier section, other arrangements are possible. One example would be a barrier section in which the nose is a separate item, in the form of an enlarged version of the dome-shaped cap described, obviating the separate cap. Both ends of the two barrier sections will then be provided with recesses that accommodate different parts of the nose. If one regards this nose as belonging to one of the barrier sections, and term that its female end, then that barrier section possesses a nose having a surface that is a surface of rotation of the profile of the base portion, as described above.

What is claimed is:

1. A barrier section having a first end and a second end, said barrier section comprising:

a comparatively narrow upright portion having one or more projections and one or more recesses at each end of said barrier section, with the number of said projections at the first end of the barrier section corresponding to the number of recesses at the second end of the barrier section and the number of recesses at the first end of the barrier section corresponding to the number of projections at the second end;

a comparatively wide base portion;

a nose defining a convexly curved external surface projecting from said comparatively wide base portion at a first end of said barrier section, said convexly curved external surface being a surface of rotation of a profile of said comparatively wide base portion;

a cavity defining a concavely curved external surface formed in said comparatively wide base portion at a second end of said barrier section, wherein said concavely curved external surface is a surface of rotation of a profile of said comparatively wide base portion, said projections and recesses being respectively shaped for allowing said projections to be brought up to recesses of an additional barrier section, said additional barrier section having a substantially identical structure to that of said barrier section, said projections and recesses being mated with one another for enabling a hinge pin to be passed through said projections of said barrier section and said additional barrier section so mated, for articulating said barrier section and said additional barrier section together, wherein said respective shaped external surfaces of said nose and cavity are shaped for conforming to one another so that when said nose of said additional barrier section is accommodated in said cavity, substantially all of said concavely shaped external surface of said cavity is juxtaposed with said convexly shaped external surface of said nose in any permitted angular orientation of said barrier sections for preventing any gap between said comparatively wide base portion of said barrier section and a comparatively wide base portion of said additional barrier section.

2. The barrier section according to claim 1, wherein each said projection has a surface that is a surface of rotation and each said recess has a corresponding surface.

3. The barrier section according to claim 2 wherein said surface of rotation of each said projection is part-cylindrical.

4. The barrier section according to claim 2, wherein said surface of rotation of each said recess is part-cylindrical.

5. The barrier section according to claim 1, wherein each said projection of said barrier section and said additional barrier section includes a bore and, when a first end of an additional barrier section is brought up to said second end of said barrier section, so that the nose is accommodated in said correspondingly shaped cavity, the bores in each said projection are aligned for allowing the hinge pin to be passed through the bores for articulating said barrier section and said additional barrier section together.

6. The barrier section according to claim 5, wherein said nose includes a bore allowing the hinge pin to pass through the bore of said nose.

7. The barrier section according to claim 6, wherein said nose includes a dome-shaped recess on an underside thereof for accommodating a dome-shaped cap, so that when a hinge pin is passed through the bore of said nose, said cap engages a lower end of said hinge pin.

8. The barrier section according to claim 1, wherein said comparatively narrow upright portion has at least one opening in a side thereof.

9. The barrier section according to claim 1, wherein said surface of rotation of said nose is obtained by partially rotating the profile of said comparatively wide base portion about an axis co-planar to the profile.

10. The barrier section according to claim 1, wherein said surface of rotation of the cavity is obtained by partially rotating the profile of said comparatively wide base portion about an axis co-planar to the profile.

11. The barrier section according to claim 1, wherein said nose has a width that is substantially equal to a width of said comparatively wide base portion.

12. The barrier section according to claim 1, wherein the cavity has a width that is substantially equal to a width of said comparatively wide base portion.

13. A modular barrier, comprising:

a plurality of substantially identical barrier sections, each having a first end and a second end; and, hinge pins for articulating a barrier section of said plurality of barrier sections with an adjacent barrier section for forming said modular barrier, with each said barrier section of said plurality of barrier sections including:

a comparatively narrow upright portion having one or more projections and one or more recesses at each end of said barrier section, with the number of said projections at the first end of the barrier section corresponding to the number of recesses at the second end of the barrier section and the number of recesses at the first end of the barrier section corresponding to the number of projections at the second end; and, a comparatively wide base portion a nose defining a convexly shaped external surface, said convexly shaped external surface being a surface of rotation of a profile of said comparatively wide base portion projecting from said comparatively wide base portion at a first end of said barrier section;

a cavity defining a concavely shaped external surface, said concavely shaped external surface being a surface of rotation of a profile of said comparatively wide base portion formed in said comparatively wide base portion at a second end of said barrier section, said projections and recesses being respectively shaped for allowing said projections to be brought up to recesses of an adjacent barrier section, said projections and recesses being mated with one another for enabling a hinge pin of said hinge pins to be passed through said projections of said barrier section and said adjacent barrier section so mated, for articulating said barrier section and said adjacent barrier section together, wherein said respective shaped external surfaces of said nose and cavity are so shaped as to conform to one another so that when said nose of said adjacent barrier section is accommodated in said cavity, substantially all of said concavely shaped external surface of said cavity is juxtaposed with said convexly shaped external surface of said nose in any permitted angular orientation of said barrier sections so to prevent any gap between said comparatively wide base portion of said barrier section and a comparatively wide base portion of said additional barrier section.

14. The modular barrier according to claim 13, wherein said hinge pin is engageable with a dome-shaped cap, said nose of each said barrier section having a dome-shaped recess for accommodating said dome-shaped cap.

15. The modular barrier according to claim 14, further comprising tension straps for holding together said adjacent barrier sections, said tension straps encircling said adjacent barrier sections and crossing from a first side of each said barrier section to a second side between said adjacent barrier sections.

16. The modular barrier of claim 15, wherein said comparatively narrow upright portion of each said barrier section has grooves for accommodating said tension straps.

17. The modular barrier according to claim 13, further comprising at least one male end piece and at least one female end piece.

18. The modular barrier according to claim 13, wherein each said projection has a surface that is a surface of rotation and each said recess has a corresponding surface.

19. The modular barrier according to claim 18, wherein said surface of rotation of each said projection is part-cylindrical.

20. The modular barrier according to claim 19, wherein said surface of rotation of each said recess is part-cylindrical.

21. The modular barrier according to claim 13, wherein each said projection of said barrier section of said plurality of barrier sections and said adjacent barrier section includes a bore and, when a first end of an adjacent barrier section is brought up to said second end of said barrier section, so that the nose of said barrier section is accommodated in said correspondingly shaped cavity, the bores in each said projection are aligned for allowing the hinge pin to be passed through the bores for articulating said barrier section and said adjacent barrier section together.

22. The modular barrier according to claim 21, wherein said nose includes a bore allowing the hinge pin to pass through the bore of said nose.

23. The modular barrier according to claim 22, wherein said nose includes a dome-shaped recess on an underside thereof for accommodating a dome-shaped cap, so that when a hinge pin is passed through the bore of said nose, said cap engages a lower end of said hinge pin, said hinge pin including a thread for engaging with an opposing thread of said cap for securing said cap to said hinge pin.

24. The modular barrier according to claim 13, wherein said comparatively narrow upright portion has at least one opening in a side thereof.

* * * * *